US011633080B2

(12) United States Patent
Li et al.

(10) Patent No.: US 11,633,080 B2
(45) Date of Patent: Apr. 25, 2023

(54) LIFT-TYPE CLEANING DEVICE FOR FLOOR WASHER

(71) Applicant: Fort Plastic & Metalwork (Jiaxing) Co.,Ltd, Jiaxing (CN)

(72) Inventors: Jing Li, Jiaxing (CN); Hao Chen, Jiaxing (CN); Hongwei Liu, Jiaxing (CN); Bin Wu, Jiaxing (CN); Yongjian Zhang, Jiaxing (CN)

(73) Assignee: FORT PLASTIC & METALWORK (JIAXING) CO., LTD, Jiaxing (CN)

( * ) Notice: Subject to any disclaimer, the term of this patent is extended or adjusted under 35 U.S.C. 154(b) by 220 days.

(21) Appl. No.: 17/020,846

(22) Filed: Sep. 15, 2020

(65) Prior Publication Data

US 2021/0085151 A1 Mar. 25, 2021

(30) Foreign Application Priority Data

Sep. 19, 2019 (CN) ..... 201921565131.9
Dec. 27, 2019 (CN) ..... 201922418159.6

(51) Int. Cl.
*A47L 13/58* (2006.01)
*A47L 11/29* (2006.01)

(52) U.S. Cl.
CPC ..... *A47L 13/58* (2013.01); *A47L 11/29* (2013.01)

(58) Field of Classification Search
CPC ..... A47L 13/58; A47L 13/59; A47L 13/50; A47L 13/502; A47L 11/29
USPC ..... 15/260, 264
See application file for complete search history.

(56) References Cited

U.S. PATENT DOCUMENTS 11,096,547 B1 * 8/2021 Zhu ..... A47L 13/58
2011/0107540 A1 * 5/2011 Shinler ..... A47L 11/40 15/245
2018/0028040 A1 * 2/2018 Delangue ..... A47L 13/58
2020/0205638 A1 * 7/2020 Dingert ..... A47L 13/50

FOREIGN PATENT DOCUMENTS

TW M-448252 U * 6/2012 ..... A47L 13/58

OTHER PUBLICATIONS

Translation of TWM-448252-U; Cai-Zheng, Lin; Jun. 2012; p. 1-8 (Year: 2012).*

* cited by examiner

*Primary Examiner* — Orlando E Aviles
*Assistant Examiner* — Sidney D Hohl
(74) *Attorney, Agent, or Firm* — Bayramoglu Law Offices LLC

(57) ABSTRACT

A lift-type cleaning device for a floor washer, a cleaning tool for cleaning a floor is disposed on the floor washer. The lift-type cleaning device includes a bucket for containing water, a drying member and a driver. The drying member and the driver are kept static during spin-drying and are disposed in the bucket. The cleaning tool is matched with the drying member. The driver is connected with the drying member and is able to control the drying member to rise. During cleaning, the drying member is located below. During drying, the. A support base is disposed in the bucket and supports the floor washer away from a bottom of the bucket. The support base is connected with the bottom of the bucket or is connected with the driver. The driver drives the support base to rise or fall.

11 Claims, 2 Drawing Sheets

LIFT-TYPE CLEANING DEVICE FOR FLOOR WASHER

CROSS REFERENCE TO THE RELATED APPLICATIONS

This application is based upon and claims priority to Chinese Patent Application No. 201921565131.9, filed on Sep. 19, 2019, and Chinese Patent Application No. 201922418159.6, filed on Dec. 27, 2019, the entire contents of which are incorporated herein by reference.

TECHNICAL FIELD

The utility model relates to the technical field of parts of floor washers, and relates to a lift-type cleaning device for a floor washer.

BACKGROUND

Mops are long-handled cleaning tools for washing floors. With the development of science and technology, automatic mops with a washing tool that can move automatically to mop floors are becoming more and more popular with people. When mop cleaning buckets in the prior art are to be switched to a cleaning mode or a drying mode, water in the buckets needs to be completely discharged, which makes operation inconvenient; and after waste water in the buckets is completely discharged, part of dirt left on the inner wall of the buckets may stain the mop again after the mop is dried, thus leading to a poorer mop cleaning effect.

SUMMARY

The objective of the utility model is to solve the above-mentioned problems by providing a lift-type cleaning device for a floor washer.

To fulfill the aforesaid objective, the utility model adopts the following technical solution:

A lift-type cleaning device for a floor washer is characterized in that a cleaning tool for cleaning a floor is disposed on the floor washer, the lift-type cleaning device comprises a bucket for containing water, a drying member and a driver which are kept static during drying are disposed in the bucket, and the cleaning tool is matched with the drying member; the driver is connected with the drying member and is able to control the drying member to rise; during cleaning, the drying member is located below; and during drying, the drying member is driven by the driver to rise and is then maintained above.

According to the lift-type cleaning device for the floor washer, a support base is disposed in the bucket and supports the floor washer away from the bottom of the bucket.

According to the lift-type cleaning device for the floor washer, the support base is connected with the bottom of the bucket or is connected with the driver, and the driver drives the support base to rise or fall.

According to the lift-type cleaning device for the floor washer, the drying member is any one or the combination of a scraper bar, a roller and a scraper brush.

According to the lift-type cleaning device for the floor washer, the drying member is connected with the support base and is fixedly or rotatably disposed on the support base.

According to the lift-type cleaning device for the floor washer, the driver is an oil cylinder or an air cylinder disposed in the bucket.

According to the lift-type cleaning device for the floor washer, the driver is an elastic piece disposed in the bucket, and the elastic piece has an end pressing against the bottom surface of the drying member and an end pressing against the bucket.

According to the lift-type cleaning device for the floor washer, the driver is a connecting rod structure disposed in the bucket, the connecting rod structure comprises a support rod hinged to the side wall of the bucket, and the two ends of the support rod are hinged to the drying member and a pedal respectively; and when the pedal is trod, the support rod on the fixed side of the drying member moves upwards to drive the drying member to move upwards.

Compared with the prior art, the utility model has the following advantages: the device can automatically clean and dry the cleaning tool, which is able to move with respect to the scraper bar, of the floor washer, and is simple in structure and easy to use; moreover, the driver can automatically switch a mop to a drying mode or a cleaning mode in real time, so that the work efficiency is improved, and the mop can be effectively prevented from being stained by dirt on the inner wall of the bucket.

Other advantages, objectives and features of the utility model will be reflected in the following description, and parts of these advantages, objectives and features of the utility model will be appreciated by those skilled in the art based on research and practice on the utility model.

DETAILED DESCRIPTION OF THE EMBODIMENTS

Embodiment 1

Figure 1:
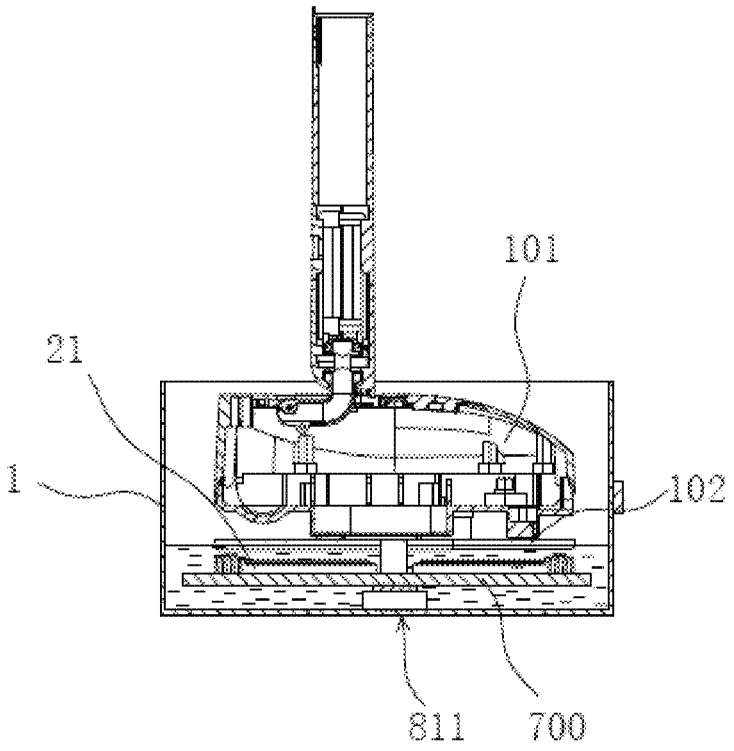
FIG. 1 is an internal structural view of Embodiment 1.
Figure 2:
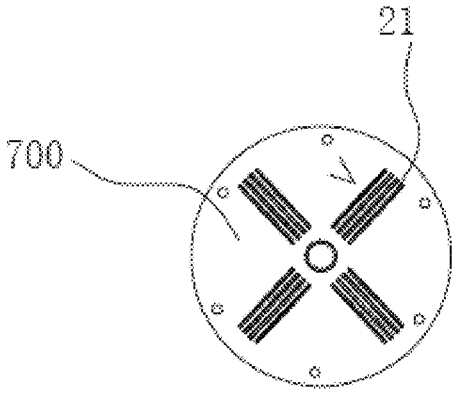
FIG. 2 is a structural view of scraper bars.
Figure 3:
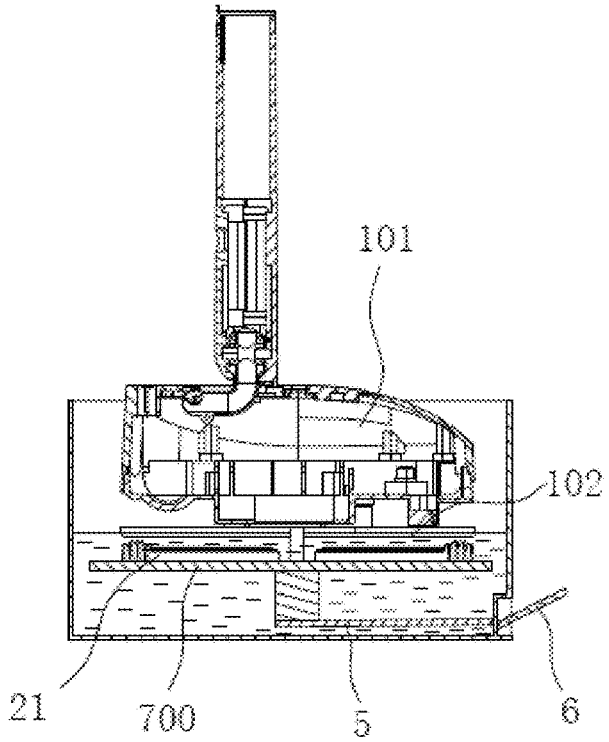
FIG. 3 is an internal structural view of Embodiment 3.
Figure 4:
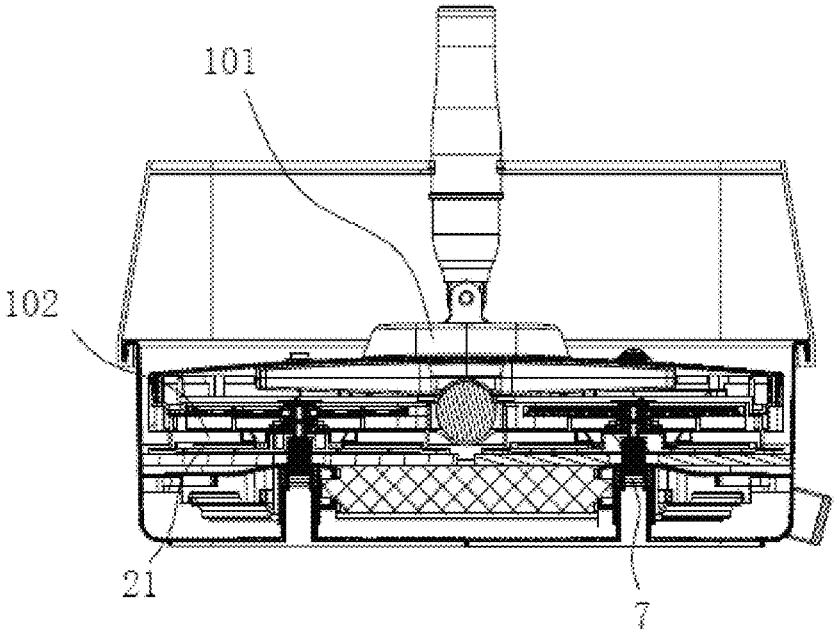
FIG. 4 is an internal structural view of Embodiment 2.

As shown in FIG. 1 and FIG. 2, a lift-type cleaning device for a floor washer is characterized in that cleaning tools for cleaning a floor are disposed in the floor washer, the lift-type cleaning device comprises a bucket 1 for containing water, drying members 21 and a driver 811 which are kept static in the drying state are disposed in the bucket 1, and the cleaning tools are matched with the drying members 21; the driver 811 is connected with the drying members 21 and is able to control the drying members 21 to rise; during cleaning, the drying members 21 are located below; and during drying, the drying member 21 is driven by the driver 811 to rise and is then maintained above.

The floor washer 101 is inserted into the bucket 1, and the cleaning tools 102 which are able to rotate circumferentially or axially or to reciprocate horizontally are connected to the bottom of the floor washer 101, and the cleaning tools 102 are in one-to-one correspondence with scraper bars.

In this embodiment, the scraper bars can be driven by the driver 811 to reciprocate in the vertical direction to be immersed in or withdrawn from cleaning water; when the scraper bars are driven by the driver 811 to be immersed in the cleaning water, the cleaning tools 102 move on the scraper bars to be cleaned; and when the scraper bars are driven by the driver 811 to be withdrawn from the cleaning water, the cleaning tools 102 can move on the scraper bars to be dried.

According to the device, the cleaning tools of the floor washer can move with respect to the scraper bars to be automatically cleaned and dried, the structure is simple, and using is easy; moreover, a mop can be driven by the driver to be automatically switched to a drying mode or a cleaning mode, so that the working efficiency is improved, and the mop can be effectively prevented from being stained by dirt on the inner wall of the bucket again.

A support base 700 is disposed in the bucket 1 and is used to support the floor washer away from the bottom of the bucket 1.

The support base 700 is connected with the bottom of the bucket 1 or is connected with the driver 811; and the driver 811 drives the support base 700 to rise or fall.

In this embodiment, as shown in FIG. 1 and FIG. 2, the driver 811 drives the support base 700 to move to drive the scraper bars to move, the end of an output shaft of the driver 811 is fixedly connected with the bottom of the support base 700 to drive the support base 700 to be immersed in or withdrawn from cleaning water to facilitate cleaning or drying.

The drying members 21 are any one or the combination of scraper bars, rollers and scraper brushes, are connected with the support base 700, and are fixedly or rotatably disposed on the support base 700.

In this embodiment, the drying members may be different scraper bars, so that the cleaning tools can be better cleaned.

The driver 811 is an oil cylinder or an air cylinder disposed in the bucket 1.

In this embodiment, when the driver 811 drives the support base 700 to enable the scraper bars to be immersed in the cleaning water, the cleaning tools 102 can move on the scraper bars to be cleaned; and when the driver 811 drives the support base 700 to enable the scraper bars to be withdrawn from the cleaning water; the cleaning tools 102 move on the scraper bars to be dried.

Embodiment 2

Embodiment 2 is basically identical with Embodiment 1 in structure and operating principle and differs from Embodiment 1 in the following aspects: the driver 811 is an elastic piece 7 disposed in the bucket 1, one end of the elastic piece presses against the bottom surfaces of the drying tools 21, and the other end of the elastic piece presses against the bucket 1.

In this embodiment, the elastic piece is spring, the floor washer is inserted into the drying tools 21 in the bucket 1, and the floor washer and the drying tools can be pressed downwards into cleaning water to be cleaned; when the floor washer is released, the floor washer will be ejected out of the cleaning water by the spring so as to be dried.

Embodiment 3

Embodiment 3 is basically identical with Embodiment 1 in structure and operating principle and differs from Embodiment 1 in the following aspects: the driver 811 is a connecting rod structure disposed in the bucket 1, the connecting rod structure 5 comprises support rods hinged to the side wall of the bucket 1, and the two ends of the support rods are hinged to the drying member 21 and a pedal 6 respectively; and when the pedal is trod, the support rods on the fixed sides of the drying members move upwards to drive the drying members to move upwards.

In this embodiment, the floor washer is inserted into the drying members 21 of the bucket 1, and the pedal can be trod to drive the drying members to move upwards through the support rods to be withdrawn from cleaning water in the bucket, so that the floor washer is dried; and when the pedal is released, the floor washer and the drying member will move downwards into the cleaning water, so that the floor washer is cleaned.

The operating principle of the utility model is as follows: the floor washer 101 is inserted into the bucket 1 to enable the cleaning tools to be located on the drying members on the support base 700; during cleaning, the drying members 21 are located below and are immersed into cleaning water; the floor washer 101 is started to drive the cleaning tools 102 to move into the cleaning water to be cleaned in cooperation with the scraper bars; during drying, the driver 811 can drive the drying members on the support base 700 to move upwards to enable the cleaning tools 102 to be withdrawn from the cleaning water, and the floor washer 101 is started to drive the cleaning tools 102 to move to be automatically in cooperation with the scraper bars.

The specific embodiments described in this specification are merely used to illustrate the spirit of the utility model. Those skilled in the art can obtain various modifications, supplements or similar equivalents of the specific embodiments described above without departing from the spirit of the utility model or exceeding the scope defined by the appended claims.

What is claimed is:

1. A cleaning device for a floor washer, a cleaning tool for cleaning a floor being disposed on the floor washer, the cleaning device comprising a bucket for being filled to a given height in the bucket with water, a drying member disposed in the bucket, wherein the drying member is configured with a shape and structure that match a shape and structure of the cleaning tool such that actuation of the cleaning tool for cleaning results in: a) spin-drying of the cleaning tool when the cleaning tool is in contact with the drying member and is disposed above the water in said bucket and b) cleaning the cleaning tool when the cleaning tool is in contact with the drying member and is at least partially submerged in the water filling the bucket to the given height; and a driver disposed in the bucket, wherein the drying member and the driver are configured to be kept static during said spin-drying;

wherein the driver is connected with the drying member and the driver is configured to control the drying member to rise above the water to implement said spin-drying of said cleaning tool and to partially submerge the drying member in said water to implement said cleaning of said cleaning tool.

2. The cleaning device for the floor washer according to claim 1, wherein a support base is disposed in the bucket and supports the floor washer away from a bottom of the bucket.

3. The cleaning device for the floor washer according to claim 2, wherein the support base is connected with the bottom of the bucket or is connected with the driver, and the driver drives the support base to rise or fall.

4. The cleaning device for the floor washer according to claim 1, wherein the drying member comprises at least one of a scraper bar, a roller or a scraper brush.

5. The cleaning device for the floor washer according to claim 2, wherein the drying member is connected with the support base and is fixedly or rotatably disposed on the support base.

6. The cleaning device for the floor washer according to claim 1, wherein the driver is an oil cylinder or an air cylinder disposed in the bucket.

7. The cleaning device for the floor washer according to claim 1, wherein the driver is an elastic piece disposed in the bucket, and the elastic piece has a first end pressing against a bottom surface of the drying member and a second end pressing against the bucket.

8. The cleaning device for the floor washer according to claim 1, wherein the driver is a connecting rod structure disposed in the bucket, the connecting rod structure comprises a support rod hinged to a side wall of the bucket, and two ends of the support rod are hinged to the drying member and a pedal respectively; and when the pedal is trod, the support rod on a fixed side of the drying member moves upwards to drive the drying member to move upwards.

9. A cleaning system comprising the cleaning tool and the cleaning device for the floor washer according to claim 1.

10. The cleaning system according to claim 9 comprising the floor washer, wherein the floor washer moves about the floor to implement said cleaning of the floor.

11. The cleaning system according to claim 9, wherein the cleaning tool is configured to rotate circumferentially or axially about an axis perpendicular to the floor, or is configured to reciprocate along a plane perpendicular to said axis.

* * * * *